US008322057B2

(12) United States Patent
Cappelle et al.

(10) Patent No.: US 8,322,057 B2
(45) Date of Patent: Dec. 4, 2012

(54) SNAP N' STRETCH STRETCHER BAR

(76) Inventors: Claudia Marie Cappelle, Woodbridge, VA (US); Richard David Karasiewski, Elkridge, MD (US)

( * ) Notice: Subject to any disclaimer, the term of this patent is extended or adjusted under 35 U.S.C. 154(b) by 272 days.

(21) Appl. No.: 12/833,903

(22) Filed: Jul. 9, 2010

(65) Prior Publication Data

US 2012/0005926 A1 Jan. 12, 2012

(51) Int. Cl.
*D06C 3/08* (2006.01)
*D06C 3/00* (2006.01)

(52) U.S. Cl. ..... 38/102.5

(58) Field of Classification Search ..... 160/382–404; 101/127.1; 38/102–102.91
See application file for complete search history.

(56) References Cited

U.S. PATENT DOCUMENTS 2,309,076 A * 1/1943 Morando ..... 38/102.8
3,482,343 A * 12/1969 Hamu ..... 38/102.5
3,830,278 A * 8/1974 Packer ..... 160/378
3,949,500 A * 4/1976 Connors ..... 38/102.5
4,144,660 A * 3/1979 Lamb ..... 38/102.5
4,179,830 A * 12/1979 Lamb ..... 38/102.5
5,515,630 A * 5/1996 Maher ..... 40/739
6,253,471 B1 * 7/2001 Strauh ..... 38/102.1

* cited by examiner

*Primary Examiner* — Ismael Izaguirre

(57) ABSTRACT

Disclosed is a stretcher bar framing and canvas fastening system. This system consists of side bar segments of variable lengths and pre-molded corner segments for quick and easy assembly and disassembly. The snap fit interlocking bar and corner segments features a locking mechanism utilizing a male plug member and a female socket member. The plug member includes a pair of resilient flexible arms with a flat surface tooth that interlocks during insertion of the socket member. The plug and socket members snap together for a tight and straight fit is released using a side release mechanism. The side release mechanism disengages the stretcher bar segments by pressing inward on the flat tooth surface of the latching arms located within the side apertures. The back side of the stretcher bar features a self-healing canvas fastening block for insertion of staples allowing canvas to be mounted or dissembled.

8 Claims, 3 Drawing Sheets

SNAP N' STRETCH STRETCHER BAR

BACKGROUND OF THE INVENTION

1. Field of the Invention

The present invention relates to the field of stretcher bar framing and canvas fastening for art canvases. More particularly this is a unique stretcher bar system using interchangeable bar segments allowing for lengthening or shortening of the sides of the frame. It features a snap fit mechanism for easy assembly or disassembly of the frame. The canvas fastener system also provides for easy mounting, re-stretching, removal, and remounting of canvas.

2. The Prior Art

In the field of art, canvas paintings are traditionally mounted to a wooden frame comprised of wooden sections referred to as stretcher bars that provide a taunt support for the stretched canvas. The stretcher bar wooden sections are assembled by means of interlocking dove-tail edges wedged together to form corner. Wooden tightening wedges are used to adjust corners to produce a perfect square. Cross braces are sometimes used as a stabilizing tension brace. Canvas or other material is stretched around and over the front perimeter of the stretcher bars and affixed to the back side by conventional means using staples or nails.

In general, current commercially known wooden stretcher bars are made in fixed sizes and frames and cannot to be customized in length and width. Several other limitations of the wooden stretcher bars include warping, difficulty in forming exact corners, and the affordability of museum depth stretcher bars. A limited number of adjustable stretcher bar frames that expand or contract in some manner are known. These adjustable frames have various limitations and are difficult to use. U.S. Pat. No. 4,519,151 discloses a hollow tubular metallic frame coupled together at the end by a co-acting pair of corner elements. The frame size can be selectively expanded and contracted by a series of five different lengths of tubular frame elements providing a means to attach fabric along the tubular edges by inserting pins in openings in the frame members. However, the disadvantage of this design is its limitation in dimension. In addition, round tubes cannot be framed and are not generally used in the field of art or accepted by galleries. U.S. Pat. No. 4,144,660 discloses an adjustable canvas stretching frame of separate, interchangeable, uniform frame segments which can be interconnected to form a limited number of size small rectangular or square frames. The primary feature of this device is to provide a means to maintain an overall rectangular shape of the frame, adjust gaps between adjacent segments of the frame, and to provide a taut surface by adjusting the tension in frame segments, with respect to each other, so a canvas can be re-stretched without damaging the canvas and/or removing the canvas from the frame. Several shortcomings to this mechanically complex design include its numerous parts and special hardware required for its assembly. Also, it does not allow for the canvas to be easily removed and reused. U.S. Pat. No. 6,675,510 discloses a lateral and longitudinal mechanized edge gripping method to avoid uneven stresses, distortion, corner wrinkles, and tearing of canvas. It primarily allows for removal and remounting of the canvas but the disadvantage is that its difficulty to evenly stretch canvas due to interference from and canvas grippers. Additional and various other prior art is also cited in U.S. Pat. No. 4,144,660, U.S. Pat. No. 4,519,151, and U.S. Pat. No. 6,675,510, and is incorporated herein by reference.

The above framing and stretching canvas references are primarily for attaching or remounting of canvas and do not allow for modifications in the overall size of the frame. The prior art does not provide the capability or means without prior training, skill, experience, or strength for quick and to easily assembly/disassembly, lengthening/shortening the stretcher bar to other frame configurations. The prior art does not allow for the stretcher bar to be easily dismantled for compact storage and for less costly transport. It also does not address the need for affordable museum quality stretcher bars.

SUMMARY OF THE INVENTION

The object of the present invention is to provide a quick and easy system to construct a frame using stretcher bar segments that are interconnected and interchangeable so that an artist can use any number of separate stretcher bar segments for any size without the need for custom made canvas frames. This system utilizes a combination of incremental length stretcher bar segments and pre-molded fixed length corner segments that allow for exact square corners without the need for adjustment. The side bar and corner segments effortlessly snap together and interlock to form an array of stretcher bar lengths. The snap fit interlocking side bar and corner segments feature both a male plug member end and a female socket member end along with a quick side-release locking mechanism.

The interior of each side bar and corner segment has a guide bar and a pair of flexible latching arms extending distally from the plug base. Each arm has a latching notch adjacent to the flat tooth surface that aligns and latches to a corresponding engagement shoulder on each side wall of the socket cavity along a center longitudinal outer axis. When the plug is fully inserted into the socket cavity, each notched flat tooth arm flexes back to its original relaxed position while the flat tooth surface extends through the open portion of the side apertures to connect and interlock the plug and socket to adjacent side bar or corner segments. Side bar and corner segments snap together and additional side bars can be added until the desired length and width of the stretcher bar frame is constructed. Each flat tooth surface fits into a corresponding aperture to evenly match the surface of the side bar and corner segments preventing indentations on the outer sides of the stretcher bar.

The inside of the side bar and corner segment has a plug guide that extends distally from the plug base and four corresponding socket cavity guides along the center longitudinal axis to direct and support the connecting side bars or corner segments. Each side bar and corner segment has an extended base on the plug side and corresponding lip along the open socket side to further secure and side bar or corner segments for a tight and straight fit.

A side-release mechanism is formed at each side wall aperture opening from the socket cavity through a portion of the outer and inside side segment walls once the plug is fully inserted into the socket. Each aperture has a single angular proximal edge engagement shoulder that cooperates and engages with a latching arm notch located on each flexible flat headed latching arm to retain and interlock the plug within the socket. Each aperture opening enables access to the plug flexible flat headed latching arms from the exterior of the socket to allow for release of a connecting side bar or corner segment. A stretcher bar frame can also be quickly disassembled, reconfigured, or stored by separating the plug and socket members. By concurrently pressing on the side-release flat tooth surfaces on each side of a side bar or corner segments, this forces each flexible internal arm to flex inward towards the center of the cavity until the flexible flat headed latching arm notch and engagement shoulder edges disengage and clear the socket proximal edge engagement shoulder to release the adjacent segment.

A further objective of this invention is to provide an easy means to fasten a canvas to the stretcher bar frame. A self healing fastening block consisting of flexible polyurethane, a resilient polyolefin, or a similar functional type material allows tack fasteners or staples to secure the canvas to the frame. The tack fasteners and staples are capable of being inserted through single or multiple layers of canvas. The penetration of the tack fasteners/staples allow for a secure holding of the canvas to the fastening block on the back side of the stretcher bar and corner segment. The durable self-healing block allows the canvas to be mounted/re-mounted stretched/re-stretched, repeatedly without damage to the frame or canvas.

The stretcher bar side and corner segments are preferably made of a low cost, light-weight, non-warping, durable plastic, resin, or any suitable material known in the art for molding or machining that provides structural durability, resiliency, and stability.

The stretcher bar dimensions follow the specifications of museum quality depth stretcher bars. (The depth is not limited to museum profiles and includes traditional and gallery depths as well.) The museum profile does not require the need for additional framing of the art work

BRIEF DESCRIPTION OF THE DRAWINGS

The accompanying drawings are included to provide a further understand of the invention, and are incorporated in and constitute a part of this specification. The drawings illustrate embodiments of the invention and, together with the description, serve to explain the principles of the invention.

DETAILED DESCRIPTION OF PREFERRED EMBODIMENT OF THE INVENTION

Figure 1:
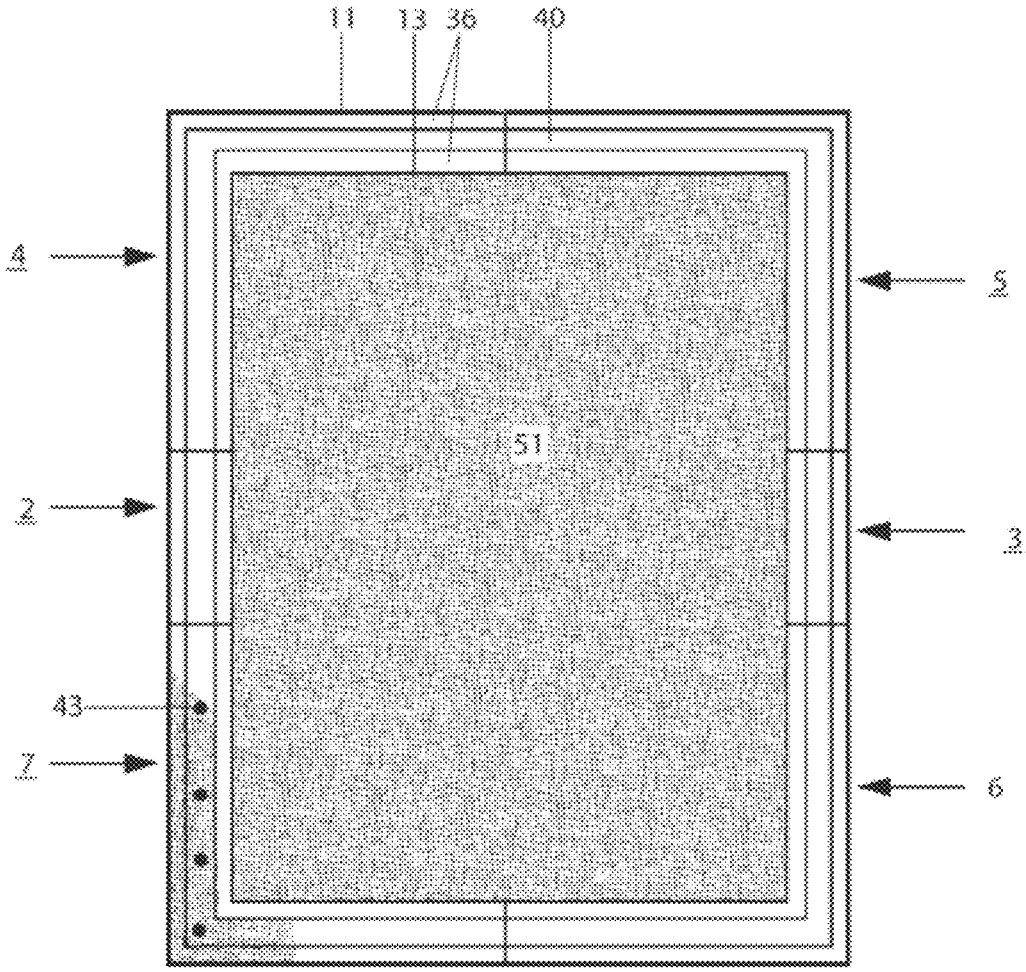
FIG. 1 is a back view of the first embodiment of the stretcher bar frame and canvas fastening system assembled in accordance with the present invention; illustrating side bar segments, corner segments, and a partially attached canvas.

The present invention relates to a novel and unique stretcher bar framing and canvas fastening system that comprises of a plurality of individual interchangeable, interconnecting (snapping together), side bar and corner segments. The stretcher bar framing system allows the user to assemble a broad range of square and rectangular shaped frames. This is accomplished by adding or removing side bar segments along the periphery within the four corner segments to lengthen or shorten the length and width of the stretcher bar. As noted above, FIG. 1 is a view that depicts an assembled stretcher bar, in one of the possible configuration. It consist of two side bar segments 2 and 3 and four corner segments 4, 5, 6, and 7. The depicted stretcher bar 1 is assembled by inserting and snapping together side bar 2 to corner segments 4 and 7, by inserting and snapping together side bar 3 to both corner segments 5, and 6, by inserting and snapping together corner segment 4 to corner segment 5, and by inserting and snapping together corner segment 6 to corner segment 7.

After assembling the two side bars segments 2, 3 and the four corner segments 4, 5, 6, and 7 to form a stretcher bar 1. FIG. 1 depicts the how a canvas 51 is attached and secured to a stretcher bar. The canvas 51 is stretched over and around the front perimeter 35, the outer side wall perimeter 11, and partially around the back side surface perimeter edges 36 of the stretcher bar. FIG. 1 also depicts how a canvas 51 is fastened to corner segment 7 with four flat headed tack fasteners 43. The process of fastening the canvas to all side bars and corner segments continue until the front side surface of the canvas is taut and flat.

The four right angle corner segments 4, 5, 6, and 7, are pre-molded and of a fixed outer length that allow for an exact square corner without the need for adjustable corner braces or a stabilizing tension brace.

The outside length of each corner segment depicted in FIG. 1 is 12 inches on outer side edge. The outside length of the side bars segments depicted in FIG. are 6 inches in length. The most common length of side bar segments are 6 inches and 12 inches (not illustrated). Side bars are always added or removed in pairs when assembling a stretcher bar.

Side bar and corner segments can be combined to assemble side lengths and widths ranging from 24 inches to 72 inches and various common size stretcher bar lengths in between. For illustrative purposes only, the number and lengths of the side bar segments and corner segments required to assembly a range of stretcher bar frame from 24×24 inches to 72×72 inches is listed below.

| Bars Required for Specific Side Lengths | | Included Number of Side Bar Segments |
|---|---|---|
| 2-12" corners | 24" | 4-12" corners |
| 2-12" corners plus 1-6" side bar | 30" | 4-6" side bars |
| 2-12" corners plus 1-12" side bar | 36" | 16-12" side bars |
| 2-12" corners plus 2-12" side bars | 48" | |
| 2-12" corners plus 3-12" side bars | 60" | |
| 2-12" corners plus 4-12" side bars | 72" | |

The overall dimensional length and width of the stretcher bar frame is not limited to 72 inches. Larger stretcher bar frames can be assembled by adding additional 6 and 12 inch side bar segments. Furthermore, with the addition and combination of 1, 2 and 4 inch side bar segments, all one inch incremental lengths and width between 24 inches to 72 inches can be assembled. The length of side bar segments and corner segments are not limited to inches and can be in other measurement units (metric). This stretcher bar framing and fastening system device for artist canvases is a significant advance in art framing.

Figure 2:
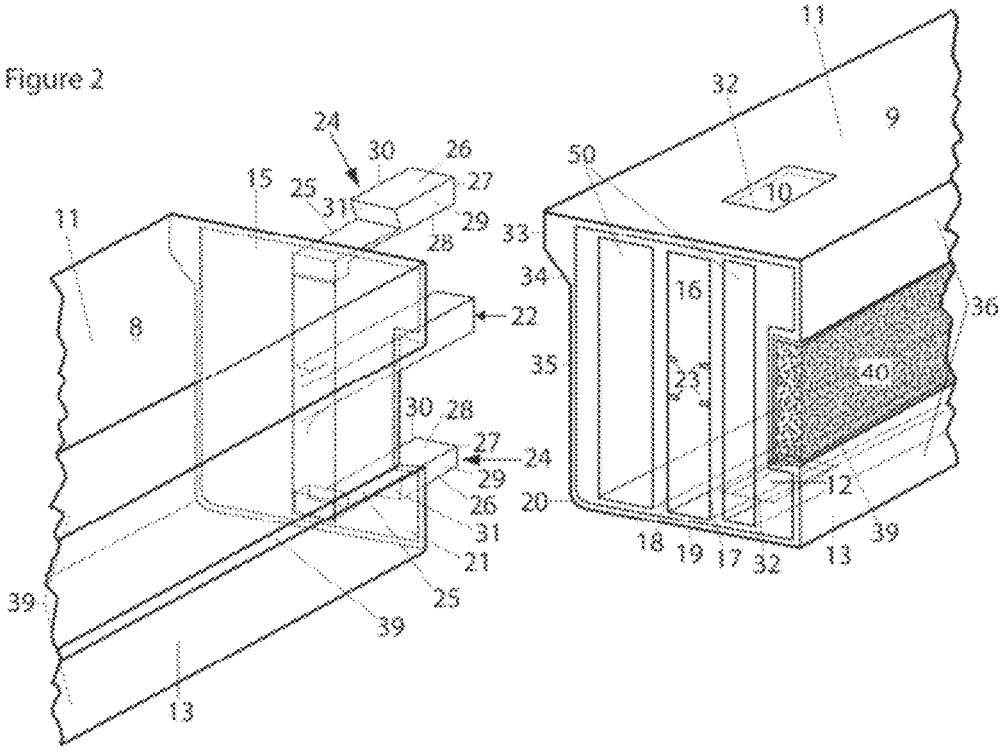
FIG. 2 is a partial three-dimensional perspective view illustrating the structural means to interconnect two adjacent stretcher bar frame segments and the back side canvas fastening system in FIG. 1.

FIG. 2 is a partial three-dimensional perspective view illustrating the snap fit structural means to snap together two adjacent stretcher bar segments of FIG. 1, taken from the back side; it depicts how side bar segment 2 is joined to corner segment 4. This same snapping together and locking mechanism is utilized to join a side bar segment to a side bar segment or a corner segment to another corner segment. Each side bar segment and corner segment can be snapped together to another side bar or corner segment by pairing a male plug member end 8 with a female socket member end 9. The interlocking side bar and corner segments features a quick release, snap fit, interlocking mechanism that utilizes a pair of flexible latching arms 24 extending distally from the projecting plug base 21 into the socket 9 of cavity 16. Each arm 24 has a latching notch 31 adjacent to its flat tooth surface 26 and a minimally curved protruding end 27 for easy insertion into the cavity 16, that aligns and latches to corresponding position in the open end socket 9 cavity 16 along a center longitudinal outer axis. Each flexible arm member notch is adapted to align and mate with each angular proximal edge engagement shoulder 32 when a plug 8 is fully inserted into a socket 9. When the plug 8 is fully inserted into the socket 9 of cavity 16, each notch 31 flat tooth 26 surface flexes outwardly back to its original relaxed position while the flat tooth surfaces 26 extends through the open outer aperture 10 of the centered outer side wall 11 and the open inside aperture 12 of the centered inside side wall 13 to connect and release the interlocking plug 8 and the socket 9 together, which process continues until the desired stretcher bar configuration is fully assembled.

A side-release mechanism is formed at each side wall through the open aperture 10 and 12 by extending an opening from the socket 9 of cavity 16 through a portion of the outer side wall 11 and inside side wall 13. Each aperture 10, 12 has a single angular proximal edge engagement shoulder 32 that cooperates with the plug 8 notch 27 to retain and interlock the plug 8 within the socket 9 cavity 16. The open apertures 10 and 12 also enable access to the plug 8 notch arms 29 from the exterior of the socket 9 to allow for quick release of connecting side bars from side bars or corner segments, or corner segments from corner segments. The particular size, shape, and location of the open aperture 10 and 12 can deviate as long as the side-release mechanism functions fundamentally as described herein.

To facilitate in guiding and align the plug 8 as it is inserted into the cavity 16 of the socket 9, a projecting plug guide bar 22 extends distally along the center longitudinal axis from the plug base 21 toward the adjacent side 15 of each side bar and corner segment for added strength in the stretcher bar frame. Projecting downward from the top cavity wall 17 and upward from the bottom cavity wall 18 are a top pair and bottom pair of projecting guides 23 that extend from the open end of the socket 9 inward and toward the adjacent side 15. The side bar 2 has an extended base on the plug 8 side and corresponding lip 20 along the entire perimeter of the open socket 9 side to further secure and strengthen side bars and/or corner segments together for a tight and straight fit. The particular size, shape, and location of the projecting guides 23 and guide bar 22 can deviate as long as the guiding mechanism functions fundamentally as described herein.

To quickly and easily disassemble the plug 8 from the socket 9, each plug 8 flat tooth surface 26 are concurrently pressed inward forcing each flexible flat headed latching arm 24 inward until the plug 8 flat headed latching arm 24 notches 27 disengage and clears the socket 9 proximal edge engagement shoulders 32 and pulling the connecting side bar segment and corner segments apart. This process is continued until the stretcher bar is completely disassembled or until the user assembles another square or rectangular shape to form a frame. This procedure is also used to disengage adjoining side bar segments and adjoining corner segments.

FIG. 2. also illustrates a view of the back side canvas fastening system in FIG. 1, illustrating the back side isosceles trapezoid shape self healing fastening block and block channel to insert tack fasteners 43 or staples to secure and fasten artist canvases to the stretcher bar. The back side center surface 36 of each side bar and corner segment includes a fastening block channel 37, consisting of a channel bottom wall surface 38, channel side wall surfaces 39, and self healing fastening block 40, which allows a means to insert tack fastener or staples 43, around the perimeter of the stretcher bar frame system in FIG. 1 to secure single or multiple layers of canvas. The self-healing fastening block 40 consists of a flexible polyurethane, a resilient polyolefin, or similar functional type material with self-healing compressive strength. Other similar or suitable materials may be used or substituted for the fastening block 40 include materials such as softwood, cardboard, rubber, silicone, or a cork-like material.

Figure 3:
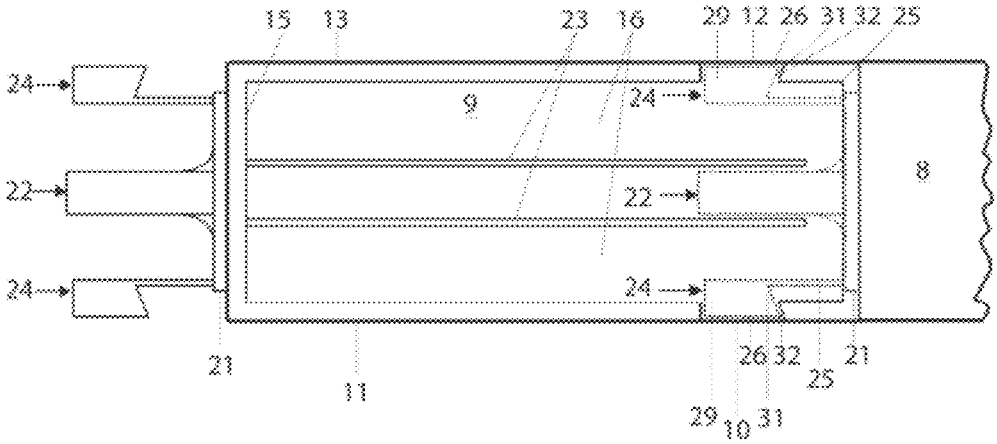
FIG. 3 is a partial two dimensional longitudinal section view of a fully inserted and interlocked male plug member and female socket member in FIG. 2, illustrating the locking mechanism means between adjacent frame segments of FIG. 1.

FIG. 3 illustrates the interlocking mechanism to retain and interlock adjacent stretcher bar side bar segments and corner segments together. As detail below, FIG. 3 depicts a partial two dimensional cross longitudinal section view of a fully inserted male plug member end 8 and female socket member end 9. Each stretcher bar side bar segment and corner segment has a male plug member end 8 and female socket member end 9, positioned at opposite ends of each of its respective segments. When the male plug member end 8 is inserted and received within the cavity 16 of the female socket member 9, the plug and socket members are mated and locked by means of a latching surface. The latching surface encompasses both angular proximal edge engagement shoulders 32, positioned on the outer side wall and inside side wall, and a mating latching notch 31 positioned on each flexible flat headed latching arm 24 of the each plug 8. The proximal edge engagement shoulder 32 is positioned to match with a latching notch 31 such that it engages and interlocks when the plug 8 is fully inserted into the socket end 9, thus securing the stretcher bar segments together. Each of the stretcher bar frame side bar and corner segment socket end 9 also includes an aperture 10 on outer side wall 11 and aperture 12 on inside side wall 13 thereof. Apertures 10 and 12 allow access to each flat tooth surface 26 of each flexible flat headed latching arm 24 from the exterior outer side wall 11 and inside side wall 13 at the socket end 9 in order to pivot the flexible flat headed latching arms 24 inward to free the connection between the latching notch 31 surfaces and the engagement shoulder 32 surfaces to allow for the release and separation adjoining stretcher bar segments.

Figure 4:
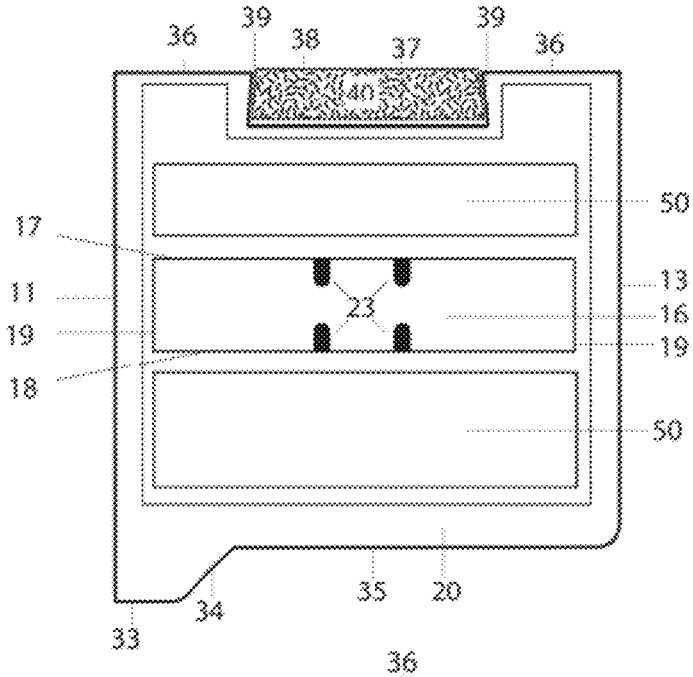
FIG. 4 is a cross-section of a stretcher bar frame segment similar to that of FIG. 2 except the frame sections have been rotated about its width-wise axis 90 degrees to illustrate the open side end thereof; illustrating the open cavities, open spaces, upward and downward projecting guides, joining lip, the self-healing fastening block, and the fastening channel.

FIG. 4 is a cross-section of a stretcher bar frame segment of FIG. 2, except that it is rotated about its length-wise axis 90° to illustrate the open side end structure thereof; and showing an open cavity 16, two open spaces 50, upward and downward projecting guides 23, that cooperate with the guide bar 22, the joining lip 20, the self-healing fastening block 40, and the fastening channel 37.

In this embodiment, the side view of each stretcher bar segment socket side 9 shows an extended outside front canvas corner 33, an angular front-side surface 34 which gradually slope downward between the outside wall 11 and the inside wall 13, and a front side surface wall 35. The extended outside canvas corner surface is integrated into each stretcher bar segment to provide a supporting rim edge around the stretcher bar frame perimeter to support canvases or other material. Adjacent extended outside front canvas corner 33 is an angular front-side surface 34 that slopes downward from the extended outside front canvas corner 33, to the larger front side surface 35 that is designed to allow the main body of the stretcher bar frame surface to remain flat and without indentation after a canvas has been fastened. The extended outside front canvas corner 33, around the stretcher bar frame perimeter serves to reduce adherence to the stretcher bar thus allowing avoidance of leaching paint or oils through a canvas.

In the middle of the bar segment socket side 9 is a substantially rectangular shaped interior cavity 16. The cavity 16 encompasses the area between an internal top cavity wall 17, an opposing bottom cavity wall 18, and a pair of side cavity walls 19, each of which connects the top wall to the bottom wall at the side edges. As previously stated, the cavity 16 allows the insertion of flexible flat headed latching arms and a guide bar to connect and interlock stretcher bar segments. FIG. 4 also depicts a back side surface 36 which includes a fastening system for insertion of tack fasteners or staples into a self healing fastening block 40 and which allows a means for tack fasteners and staples to secure canvases and other materials to the stretcher bar.

Figure 5:
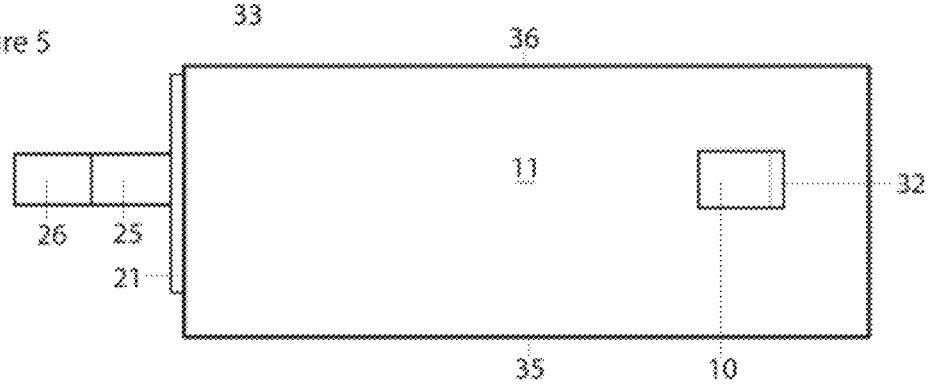
FIG. 5 is similar to that of FIG. 2 except the bar frame section has been rotated about its length-wise axis 90 degrees to illustrate the outside release aperture.

FIG. 5 is similar to that of FIG. 2 except the bar frame section has been rotated about its length-wise axis 90 degrees to illustrate the features of the outside release aperture and to illustrate the outer side of the stretcher bar frame wall 11 and outer side release open aperture 10, that is utilized to gain access to the flat tooth surface 26 of the flexible flat headed latching arm 24 in order to pivot the flexible flat head latching arms 24 inward to free the connection between the latching notch 31 surfaces and the engagement shoulder 32 surfaces to allow for the release and separation adjoining stretcher bar segments. The outside stretcher bar view also shows a projecting plug base 21 located between the flexible flat headed latching arm 24 and the adjacent side wall 15. Each stretcher bar segment has a projecting plug base 21 that corresponds to a joining lip 20 around the open cavity 16. The interconnecting of the projecting plug base 21 and joining lip 20 enables the projecting plug base 21 and joining lip 20 to align, mate, and secure and stretcher bar frame segments for an additional tight and straight fit.

Figure 6:
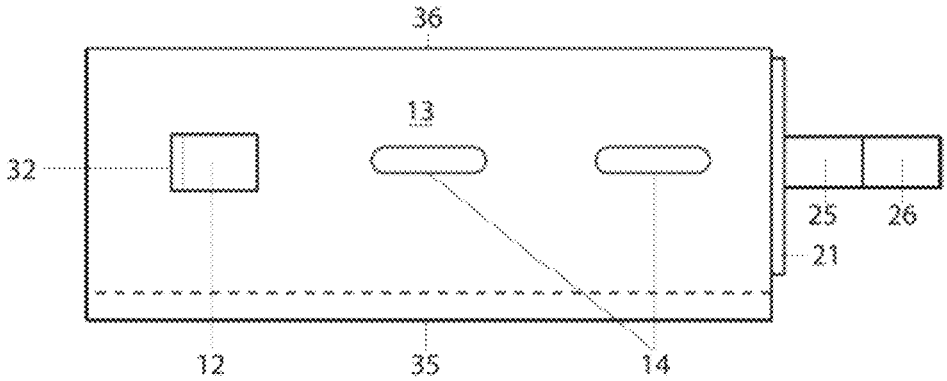
FIG. 6 is similar to that of FIG. 2 except the bar frame section has been rotated about its length-wise axis 90 degrees to illustrate the inside release aperture, cross-brace port/hanger wire ports.

FIG. 6 is similar to that of FIG. 2 except the bar frame section has been rotated about its length-wise axis 90° to illustrate the inside release aperture, cross-brace port/hanger wire ports, and to illustrate the inside stretcher bar frame wall 13 and outer side release open aperture 13. Each stretcher bar segment inside wall 13 has cross-brace entry port connection and hanger wire ports 14. The cross-brace entry ports 14 are incorporated and available for tension and stability if a cross-brace is necessary. These same ports connection/hanger wire ports 14 allow for insertion of hanger wires to allow the stretcher bar frame 1 and its canvas to be hanged for art gallery displays or exhibitions.

The specifications and drawings of this invention may be embodied and practices in other specific forms and modification without departing from the spirit and essential characteristics thereof. The present embodiments therefore are considered in all respects as illustrative and not restrictive. The scope of the invention is indicated by the appended claims rather than by the foregoing description. All variations, substitutions, departures, and changes that come within the meaning and range of equivalency of the claims therefore are intended to be embraced therein.

What is claimed is:

1. A stretcher bar framing and fastening system for mounting, re-stretching, remounting, and removing artist canvas comprising:

a plurality of snap fitting, interlocking, interchangeable, variable lengths, side bar segments and fixed length right angle corner segments, featuring a locking mechanism utilizing a male plug member and a female socket member, that interconnect to form an array of various sizes of square or rectangular frames;

a female socket member end having an open cavity at a center width-wise axis thereof, having a connecting internal top wall, a bottom wall, and a pair of opposing side walls, which is open at the open end and closed at the adjacent end;

a male plug member end having flexible flat head latching arm members for insertion through the open end of said cavity of said female socket member, each said flexible arm member running distal and parallel along opposite sides of the plug member, wherein each said flexible arm member having a pivotal flexible arm member stem, a flat tooth outer side surface, a latching notch, an arm member top surface, an arm member bottom surface, a protruding end, and an arm member back side surface;

a female socket member having angular engagement shoulder surfaces extending and directing from the inner to an outer surface of each side walls of said socket member, each angular engagement shoulder being disposed on a midway line between said top wall and said bottom wall of said cavity, each angular engagement shoulder being adapted to mate with a corresponding latching notch on each said flexible flat headed latching arm member, when each said flexible flat headed latching arm member is fully inserted into the open end of said cavity, to engage and interlock said plug member to said socket member;

a notch adjacent to said flat tooth outer side surface on each said flexible flat headed latching arm, said latching notch and said angular engagement shoulder defines a locking proximal edge, said locking proximal edge being positioned, to latch to a corresponding position in the open end socket member cavity;

a means for disengaging said latching notch on said flexible flat headed latching arm member of said plug member, from said engagement shoulder of said socket member, to permit decoupling of said plug member from said socket member;

an extending guide bar running distal and parallel between two said flexible flat headed arm members on said plug member, between mating guide bar projections extending downward from the top cavity wall surface and upward from the bottom cavity wall surface of said cavity of said socket member, running parallel from said cavity open side to said adjacent side surface;

a joining lip around the outer perimeter edge of said socket member that mates with a projecting plug base to further align and secure said adjacent plug member on said side bar or corner segments;

a fastening channel with a self-healing block on the back side surface of each side bar and corner segment to attach and secure canvas to said stretcher bar frame with tack fasteners or staples; and a stretcher bar front side outer surface, on all side bar and corner segments, having an extended outside front corner, over which a canvas is stretched, adjacent to an angular front-side surface, that sloping downward towards the front side surface.

2. The stretcher bar frame according to claim 1 wherein each side bar and corner segments has a male plug member and female socket member positioned at opposite ends.

3. The stretcher bar frame according to claim 1 wherein the length and width can be increased or decreased by adding or removing side bar segments to form an array of various sizes square or rectangular frames.

4. The stretcher bar according to claim 1 wherein the outer surface wall and inside side wall surface each having a predetermined thickness forming angular proximal edge engagement shoulders, wherein each said angular engagement shoulder corresponds to each said latching notch on said flexible flat headed latching arm member through a longitudinal axis situated midway between outer side and inner side surface.

5. The stretcher bar according to claim 1 wherein each said flexible flat head latching arm having a latching surface notch, said latching surface notch being adapted to mate with and affix against said proximal edge engagement shoulder forming an engaging locking surface, when said plug member is coupled to said socket member.

6. The stretcher bar according to claim 1 wherein the means for disengaging each flexible flat headed latching arm through said side walls of said socket member, whereby each said flat tooth surface is exposed through each said aperture when said plug member is coupled to said socket member.

7. The stretcher bar according to claim 1 wherein said means for disengaging comprises of flexible arm member stems which are coupled between said plug member notches and said proximate edge engagement shoulder members, and which are adapted to be pivoted away from said side walls of said socket member inwardly towards said cavity to release and free said latching notches from said engagement shoulders to permit decoupling of said plug member from said socket member.

8. The stretcher bar according to claim 1 wherein said means for quickly decoupling and disassembling stretcher bar frame segments to a transportable size for storing or shipping.

* * * * *